US009593490B2

(12) United States Patent
Anic

(10) Patent No.: US 9,593,490 B2
(45) **Date of Patent: *Mar. 14, 2017**

(54) SIDING SYSTEM

(71) Applicant: Jeffrey Sargen, York, PA (US)

(72) Inventor: Miro Anic, Mechanicsburg, PA (US)

(73) Assignee: Jeffrey Sargen, York, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/061,304

(22) Filed: Mar. 4, 2016

(65) Prior Publication Data

US 2017/0044774 A1 Feb. 16, 2017

Related U.S. Application Data

(63) Continuation of application No. 14/822,413, filed on Aug. 10, 2015, now Pat. No. 9,309,677.

(51) Int. Cl.
*E04F 13/24* (2006.01)
*E04F 13/08* (2006.01)

(52) U.S. Cl.
CPC ..... *E04F 13/0862* (2013.01); *E04F 13/0864* (2013.01); *E04F 13/24* (2013.01)

(58) Field of Classification Search
CPC . E04F 13/0864; E04F 13/0803; E04F 13/081; E04F 13/0814; E04F 13/18
USPC ..... 52/543, 536, 546, 549, 551, 478, 489.1, 52/314
See application file for complete search history.

(56) References Cited

U.S. PATENT DOCUMENTS 2,820,535 A * 1/1958 Hutchison ..... E04F 13/0848 52/520
2,974,703 A * 3/1961 Rapata ..... B60Q 1/0683 174/153 G
3,106,994 A * 10/1963 Scott ..... F16B 5/0291 403/231
3,188,774 A 6/1965 McCorkle
3,312,028 A 4/1967 Schroyer
3,462,906 A 8/1969 Schroyer
3,621,625 A 11/1971 Medow
3,705,471 A * 12/1972 Allen ..... E04B 2/78 52/243
3,707,061 A 12/1972 Collette et al.
3,824,756 A 7/1974 Kessler
3,826,054 A 7/1974 Culpepper, Jr.
3,998,018 A 12/1976 Hodges
4,267,680 A * 5/1981 Delattre ..... E04F 15/02405 52/384
4,288,958 A 9/1981 Chalmers et al.
(Continued)

*Primary Examiner* — Brent W Herring
(74) *Attorney, Agent, or Firm* — Drinker Biddle & Reath LLP

(57) ABSTRACT

A siding system has elongated stringers, each having a plurality of clips spaced at regular intervals along its length. In use, the stringers can be mounted upright, spaced apart and parallel, on an upright wall, and aligned so that the clips are in horizontal rows. A siding panel has a plurality of elongated connectors, spaced apart and parallel, on a rear face. In use, the panel can be mounted upright, with the connectors horizontal, and each connector engaged in the clips of one of the horizontal rows of clips so that the weight of the panel is supported by the clips of a plurality of the horizontal rows of clips through the connectors.

12 Claims, 4 Drawing Sheets

(56) References Cited

U.S. PATENT DOCUMENTS

| | | | | | |
|---|---|---|---|---|---|
| 4,296,582 | A | * | 10/1981 | Simpson | E04C 2/526 52/592.1 |
| 4,517,783 | A | * | 5/1985 | Harder | E04D 3/32 52/481.1 |
| 4,522,002 | A | | 6/1985 | Davis et al. | |
| 4,947,609 | A | | 8/1990 | Champagne | |
| 1,918,228 | A | | 7/1993 | Spencer | |
| 5,339,608 | A | | 8/1994 | Hollis et al. | |
| 5,349,802 | A | | 9/1994 | Kariniemi | |
| 5,363,623 | A | | 11/1994 | King | |
| 5,606,835 | A | | 3/1997 | Champagne | |
| 5,622,020 | A | | 4/1997 | Wood | |
| 5,810,501 | A | * | 9/1998 | Ross | F16B 37/005 403/231 |
| 5,878,543 | A | | 3/1999 | Mowery | |
| 6,044,609 | A | | 4/2000 | Kim | |
| 6,138,423 | A | | 10/2000 | Poutanen et al. | |
| 6,367,220 | B1 | | 4/2002 | Krause et al. | |
| 6,526,718 | B2 | | 3/2003 | Manning et al. | |
| D479,797 | S | * | 9/2003 | Wall | D25/119 |
| 6,874,290 | B1 | | 4/2005 | Bokan | |
| 6,955,019 | B2 | * | 10/2005 | Donlin | E04F 13/18 52/314 |
| 7,390,145 | B2 | * | 6/2008 | Wall | E02D 5/08 405/278 |
| 7,658,051 | B2 | | 2/2010 | Benes | |
| 8,033,066 | B2 | | 10/2011 | Griffiths et al. | |
| 8,096,091 | B2 | | 1/2012 | Cristina | |
| 8,191,327 | B2 | | 6/2012 | Griffiths et al. | |
| 8,590,249 | B1 | | 11/2013 | Loper et al. | |
| 9,091,078 | B2 | * | 7/2015 | Desch nes | E04F 13/0803 |
| 9,309,677 | B1 | * | 4/2016 | Anic | E04F 13/0814 |
| 2006/0117694 | A1 | | 6/2006 | Godby | |
| 2010/0229488 | A1 | | 9/2010 | Cristina | |
| 2015/0082728 | A1 | | 3/2015 | Peck et al. | |

* cited by examiner

SIDING SYSTEM

FIELD OF THE INVENTION

The invention relates generally to a system for mounting siding on a wall of a building.

BACKGROUND

It is well known to cover the external walls of a building with horizontal planks, known as "siding." More recently, similarly shaped panels of aluminum or plastic have been used for the same purpose. Plastic siding panels are typically several feet long and 8 to 12 inches high, and may be molded to imitate the appearance of two or three narrower planks. These panels are typically attached to the substructure of the building by nails driven through slots in the top edge of the panel. The height of the panel is limited to eight or 12 inches by the amount of weight that can satisfactorily be hung from the top edge of the panel. As with traditional siding, the bottom panel is set to a reference line, for example, a snapped chalk line, and each successive panel is mounted overlapping the panel below. This system has the considerable disadvantage that, because the relatively narrow panels must be attached one at a time working up from the bottom of the wall, it is difficult to keep the panels accurately horizontal and parallel. That is especially true when the siding is being installed by a homeowner or other person who is not professionally trained. Also, the process cannot easily be mechanized, because the nails must be left slightly loose, so that the panels can slide from side to side as they expand or contract. That makes the use of power-operated nail guns very difficult.

It has also been proposed to provide clips attached to the substructure to which the siding panels can be attached. That makes attaching the actual panels quicker and easier, but at the expense of requiring great effort to position the clips accurately spaced and in horizontal lines.

U.S. Pat. No. 4,288,958 to Chalmers et al. proposes a siding system with long vertical stringers that have clips preformed at regular intervals. Each clip supports the top of one panel, and retains the bottom of the panel above. In addition, an extra tab is provided midway between adjacent clips, which can be used to stabilize a vinyl panel formed with the appearance of two planks.

However, Chalmers's device has significant limitations. First, because the panel is still supported only at the top, the height of the panel is still limited to 8 to 12 inches. Second, Chalmers's system requires the top of the panel to be partly inserted into the clip above so that the panel is loosely supported. The panel is then pressed against the stringers, and finally slid upwards so that the panel becomes locked into the clip at its top and hooked under the clip at its bottom and, if applicable, the additional tab in the middle. That is a rather awkward maneuver to carry out over the length of a long panel, because the whole length of the panel, both along the middle and along the bottom, must be held close against the stringers at one time. If the panel is being installed above a window frame or the like that projects from the wall, so that the panel cannot slide over the window frame, the upward movement would leave a gap that would need to be covered over, and a standard J-channel could not be used. In addition, Chalmers's siding panels do not appear to be easy to remove. The metal clips would likely bend out of shape, and the vinyl panels interlock with barbs. His vinyl panels also appear difficult to manufacture, because they appear to be a modification of a design originally intended to be made of aluminum sheet.

There is therefore still room for considerable improvement in the design of siding panels and siding panel mounting systems.

SUMMARY

According to one aspect, a siding system comprises a plurality of elongated stringers, each having a plurality of clips spaced at regular intervals along its length, adapted to be mounted upright in spaced, parallel relation on an upright wall and to be aligned so that their respective clips are in horizontal rows, and a siding panel having on a rear face a plurality of spaced, parallel, elongated connectors, each connector adapted to be engaged in the clips of one of the horizontal rows of clips so that the weight of the panel is supported by the clips of a plurality of the horizontal rows of clips through the respectively engaged connectors.

The connectors can be arranged to be inserted into the clips and removed from the clips horizontally, which makes assembly much easier, because the connectors can be inserted one at a time while the panel is held in approximately its final position or, if sufficiently flexible, is rolled into position from the bottom. A significant advantage is that installation does not become more awkward as the number of connectors increases. That is in contrast to previous designs, where all the clips had to be engaged at once by an upward movement of the whole panel, so that every single clip for the entire panel had to be correctly aligned when that upward movement was made, which would become disproportionately more awkward as the number of clips increased.

Because the clips and connectors support the weight of the panel at regular intervals up its height, the height of the panel is no longer limited by the weight that can be hung from its top edge. The panel may have more than four horizontal connectors, where Chalmers limited himself to three.

The combination of the two features last mentioned makes it practical to use much higher panels than was previously feasible. Where existing systems are limited to panels 8 to 12 inches (20 to 30 cm) high, the present system permits panel heights limited only by the sizes that can be shipped and stored. That offers significant savings in installation time and in cost, both of which include a substantial per-piece component. That also reduces the number of joints in any given area of siding, which is desirable because any joint is a source of vulnerability either to water penetration or to mechanical failure.

The spacing between adjacent horizontal connectors is preferably equal to the spacing between adjacent rows of clips, but either spacing may instead be a multiple of the other.

Each clip may define a channel perpendicular to the length of the stringer and with a narrower neck, and each connector may then comprise a bead on a narrower rib, the connector bead dimensioned to fit within the clip channel and to snap in and out of the channel through the neck, and the connector rib dimensioned to fit within the clip neck.

The clip channels may then be open through the necks in a direction perpendicular to the length of the stringers and to the length of the channels.

The panel may be made of sheet material, and each connector bead, together with its narrower rib, may be formed by a corrugation or loop in the sheet material.

The stringers may be mounted upright in spaced, parallel relation on an upright wall and aligned so that their respective clips are in horizontal rows, and the siding panel may then be mounted on the stringers with its connectors horizontal and engaged in the clips of respective ones of the horizontal rows of clips so that the weight of the panel is supported by the clips of a plurality of the horizontal rows of clips through the respectively engaged connectors.

In another aspect, a stringer for a siding system comprises a member elongate in a length direction and having a width direction and a depth direction perpendicular to each other and to the length direction, and a plurality of clips regularly spaced along the length of the elongate member, each clip projecting from the elongate member in the depth direction and defining a channel extending in the width direction, the channel open away from the elongate member in the depth direction through a neck extending in the width direction. Each clip is so constructed as to permit an elongated connector extending in the width direction to snap into the channel through the neck, and to support the connector against forces in the length direction while the connector is received in the channel.

In another aspect, a panel for a siding system has a rear face and a plurality of elongated connectors on the rear face, the connectors being parallel and evenly spaced apart, each connector comprising a head having a length extending across a width of the panel, being of uniform cross-section along its length, and being connected to the rear face of the panel by a rib narrower than the head.

Such a stringer or panel may have any of the optional features of the siding system already mentioned.

DETAILED DESCRIPTION

Figure 1:
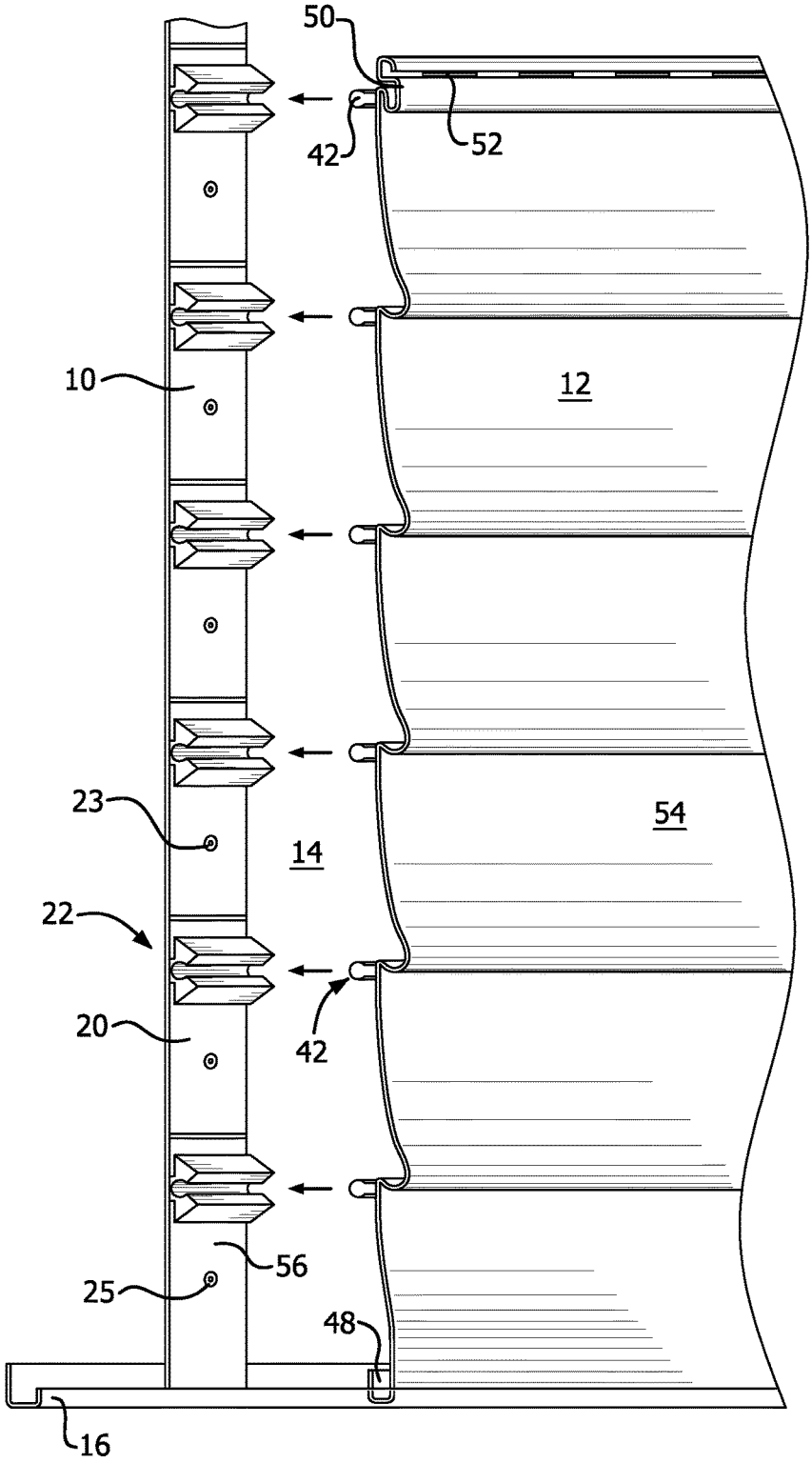
FIG. 1 is a perspective view of components of an embodiment of a siding system.

Referring to the drawings, an embodiment of a siding system consists primarily of stringers 10 and siding panels 12, which in use are mounted on the vertical wall 14 of a building. The stringers 10, one of which is shown in FIG. 1, are spaced apart along the wall 14 at more or less even intervals. For example, the stringers 10 may be aligned with studs or other framing in the wall 14, or certain stringers 10 may be located at important positions such as an end of a section of wall 14 and other stringers 10 may then be evenly spaced between them. Where the building has an inner skin of, for example, ¾ inch (19 mm) plywood, the stringers 10 may be fastened to the inner skin without needing to be aligned with the underlying studs or other framing. In an embodiment, the stringers 10 may be at intervals of 16 inches (40 cm), which may be reduced to 12 inches (30 cm) in areas where high winds are common.

As shown in FIG. 1, a conventional J channel 16 is positioned along the bottom of the wall 14, and the bottom ends of the stringers 10 are set in the J channel 16. The installer should ensure that the stringers 10 are level with each other, either by first setting the J channel 16 accurately, or by providing a separate guide line and setting the bottom ends of the stringers 10 to the guide line.

Each stringer 10 comprises a strip of material 20, preferably vinyl or other suitable plastic material, with clips indicated generally by the reference numeral 22 at regular intervals up the strip 20. In an example, the strip 20 may be 1 inch (25 mm) wide, and ⅛ inch (3 mm) thick, and may be made of polyvinyl chloride material of a grade commonly used for plastic lumber. Stringer 10 is attached to the wall 14 by nails, screws, or other suitable fastenings 23. The fastenings 23 may be inserted into preformed holes 25 in the vinyl strip 20 or may simply be driven through the vinyl strip 20.

Figure 2:
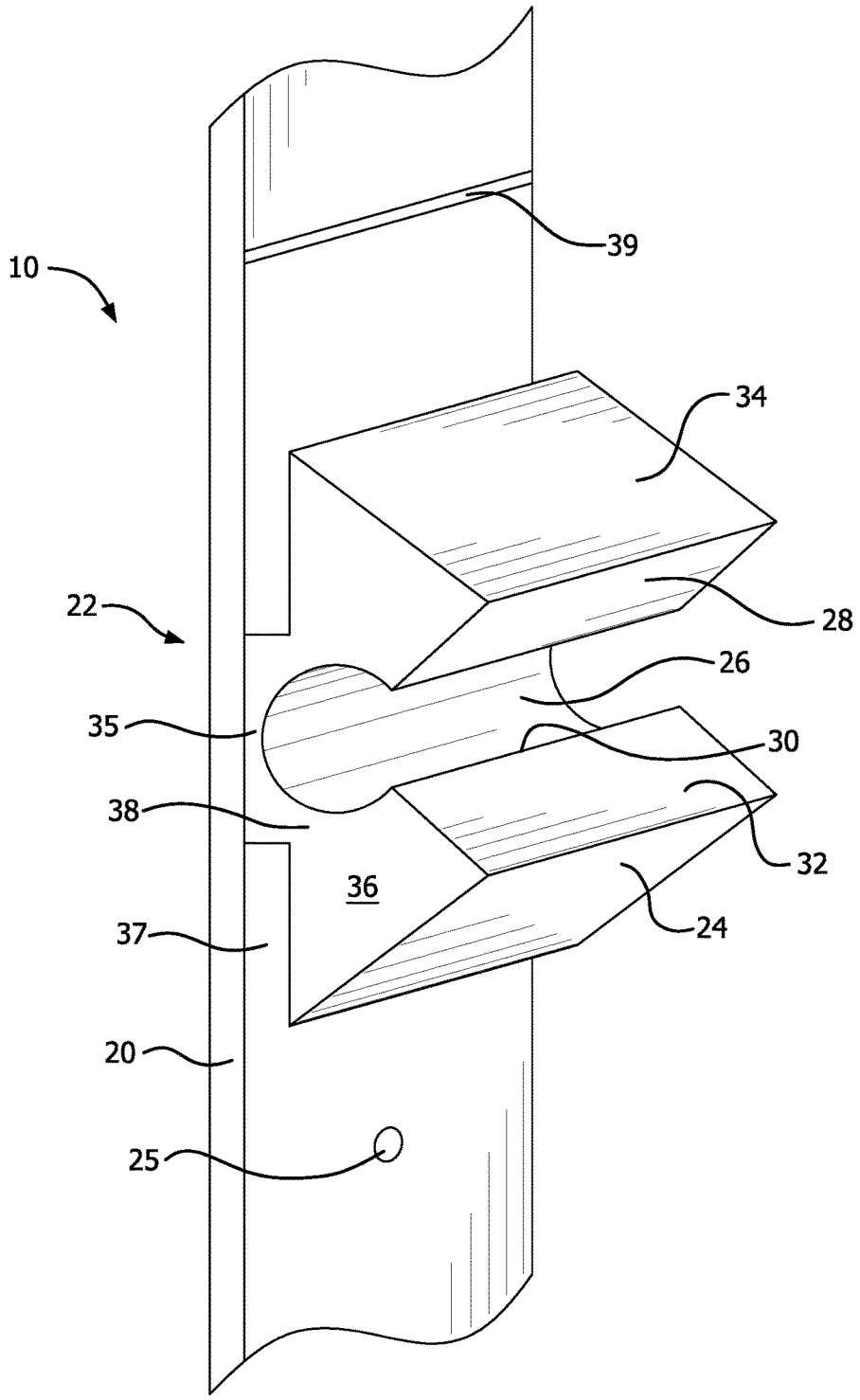
FIG. 2 is a perspective view, to a larger scale than FIG. 1, of part of a stringer in the embodiment of FIG. 1.

Referring now also to FIG. 2, each clip 22 comprises a block of material 24 projecting from the strip 20 and having a horizontal channel 26 formed in the block 24. The channel 26 is open at the side 28 away from the strip 20, through a neck 30 that is narrower than the vertical width of the main part of the channel 26. Outside of the neck 30, the open side 28 is defined by angled surfaces 32 that diverge outwards. Above and below the channel 26, the block 24 is bounded by angled surfaces 34 facing away from the channel 26. The purpose of the angled surfaces 32 and 34 will be described in more detail below. The block 24 is attached to the strip 20 by a stalk 35 that extends the entire width of the clip 22 along the back of the channel 26. Above and below the stalk 35, the parts 36 of the block 24 that define the angled surfaces 32 and 34, and the upper and lower sides of the channel 26, are separated from the strip 20 by gaps 37. A narrow waist 38 is thus formed between each gap 37 and the channel 26, at which the block parts 36 are able to flex towards and away from each other. The stiffness of the waist 38 is determined by the composition of the vinyl material in combination with the width of the waist 38 which is set by choosing the exact position of the inner edge of the gap 37.

Above each clip 22, a shallow groove, rib, or other mark 39 is formed across the strip 20. This mark 39 is positioned so that when the top edge of a panel 12 is aligned with the mark 39, the topmost connector 42 on a panel is correctly aligned with its respective clip 22. That can assist in mounting the panels 12.

Referring again to FIG. 1, the panel 12 is provided on its rear surface 40 with connectors indicated generally by the reference numeral 42, which are spaced apart vertically at a distance equal to the vertical spacing between the clips 22. As shown in the drawings, the panel 12 is formed in strips 54 to imitate horizontal planking, and the connectors 42 are positioned at the steps between the planks 54. That has the advantage that any distortion in the vinyl or other plastic material of the panel 12 at the point of attachment of the connectors 42 is concealed, and that the weight of the panel 12 is most efficiently transmitted to the connectors 42. However, those features are not essential, and other vertical spacings, or other styles of panel, may be chosen.

Figure 3:
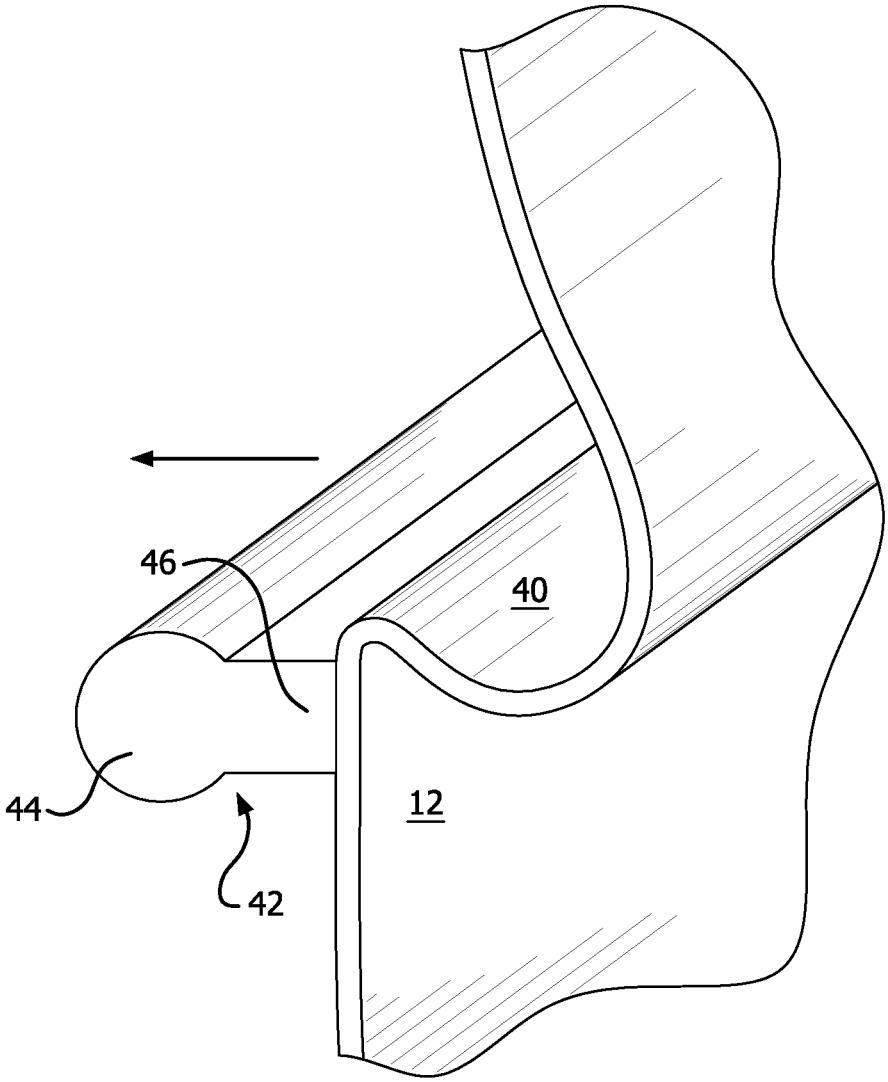
FIG. 3 is a perspective view, to a larger scale than FIG. 1, of part of a panel in the embodiment of FIG. 1.

Referring also to FIG. 3, each connector 42 comprises a bead 44 connected to the panel 12 by a narrower rib 46. The bead 44 is dimensioned to fit snugly in the channel 26 of the clip 22, without rattling but not so tightly as to prevent the panel 12 from expanding or contracting with changes of temperature. The rib 46 is dimensioned to fit snugly within the neck 30 of the connector 22. The dimensions of the clip 22 and the connector 42, and the stiffness of the material of the clip 22, are chosen so that the bead 42 can be snapped into and out of the channel 26 through the neck 30 without requiring a force that would damage other parts of the system or could not be easily exerted by an installer or repairer, but so that in normal use of the siding the panel 12 remains securely attached to the stringer 10.

As shown in FIG. 3, the connector 42 is continuous across the whole width of the panel 12. That ensures that the connector 42 can engage with the clips 22 without requiring any specific positioning of the stringers 10 or any specific alignment between the stringers 10 and the panel 12. The connectors 42 also act as stiffening ribs for the panels 12. However, the connectors 42 may stop short of the edge of the panel 12 at one lateral side of the panel, so that when cladding a long wall the panels can be overlapped slightly, for neater appearance and better weatherproofing. In one example for use in the United States of America, the panels 12 may have a nominal width of 12 feet (approximately 3.65 meters) and may actually be 12 feet 2 inches long (approximately 3.7 meters) with the connectors 42 omitted for about 2¼ inches (60 mm) at one side. The extra quarter of an inch is to allow for expansion of the panels 12 on hot days.

In use, the stringers 10 and the J channel 16 are first attached to the wall 14. The stringers 10 need to be aligned so that the clips 22 form straight, horizontal rows. However, the strips 20 are sufficiently inelastic that once the bottom ends of the stringers are set to a guide line, the clips should line up almost automatically. In case it is necessary on a high wall to install two stringers one above the other, it is preferred, though not necessary, that the length of the end stubs 56 of the stringer 10 above the top clip 22 and below the bottom clip 22 add up to the regular spacing between clips 22, so that where two stringers 10 are placed one above the other, the stubs 56 act as spacers to continue the regular spacing of the clips 22 from one stringer 10 to the next. Where stringers 10 are cut to length to fit the wall 14, the installer can easily choose the point of cutting, or trim the cut pieces, so that the stubs on the cut pieces have the correct lengths. However, if the stubs are shorter, or if the stringers 10 are not vertically one above the other (for example, because the siding has to be shaped round a window opening) then a small piece of a panel 12, including parts of two connectors 42, can easily be used as a height gauge to set the vertical spacing.

Then, a J shaped lip 48 at the bottom of the panel 12 is located in or under the J channel 16. Working up the wall from the bottom, the bead 44 of each connector 42 is then inserted into the channels 26 of the clips 22 by pushing the bead 44 in horizontally, in the direction of the arrows in FIGS. 1 and 3. As may be seen from FIG. 2, the angled surfaces 32 at the open side of the channel 26 will act as a funnel to guide the bead 44 into the neck 30 of the channel 26. If the bead 44 is initially too high or too low to align correctly with the clip 22, it may be slid up or down, and the angled surfaces 34 on the outside of the clip 22 will then deflect the bead 44 away from the stringer 10 so that the bead 44 can slip into the funnel formed by the inner angled surfaces 32. That may occur, for example, if there is significant flexibility in the panel 12 at the steps between adjacent planks 54. The connectors 42 act as stiffening ribs, helping to keep the panel 12 straight along its length, while allowing the panel 12 to flex from top to bottom, which further assists installation.

As shown in FIG. 2, the panel 12 is considerably higher than a conventional siding panel and has several connectors 42 at intervals up its height. Because of the improved design of the clips 22 and connectors 42, they can support the weight of the panel 12. The height of the panel 12 is therefore no longer limited by the weight that can be hung from its top edge. In addition, because the connectors 42 are inserted into the clips 22 horizontally, they can be inserted one at a time, and the height of the panel is therefore no longer limited by the need to control the panel while engaging every attachment clip simultaneously. In principle, it would be possible to provide the panel 12 in the form of a strip or roll of indefinite length that is cut to the height of the wall 14. In practice, however, panels 12 in one or more standard heights may be more practical. Each panel 12 may then be provided along its top edge with a margin 50 that is shaped to engage a conventional soffit piece (not shown) or to engage the bottom channel 48 of a next panel 12 above. As shown in FIG. 1, the top margin 15 may be provided with slots 52 for nails, in the case the top of the panel 12 cannot be supported by its connector 42 and the clips 22.

In addition, a nail may be inserted into a slot 52 of each panel 12 to prevent the panels from "walking" across the wall 14 if the panels repeatedly expand and contract with changes in temperature. A nail should not be necessary when, as is preferred, the left and right ends of the panels 12 are received in channel pieces at the corners of the wall 14 or at window or door openings, or are otherwise prevented from escaping sideways. Such channel pieces may be conventional and, in the interests of conciseness, are not further described.

If a very long windowless and doorless section of wall 14 requires two or more panels 12 side by side, a nail may be appropriate. But because the nail is provided only to prevent walking, and not to support the panel, a single nail, usually at the center of the length of the panel, should be sufficient. The panel can then expand and away from and contract towards the nail on both sides, and does not need to move past the nail. The nail can therefore be tightly set, and can be applied with a nail gun or other machinery and, even when using a hammer, without the special care previously needed to leave the nails slightly loose.

Because the panel 12 is held in place by a grid of closely spaced clips 22 in a regular array, as little as 4 to 6 inches (10 to 15 cm) apart vertically and 12 to 16 inches (30 to 40 cm) apart horizontally, the panel is exceptionally stable, with little tendency to "bubbling" or bulging. The stiffening action of the connectors 42 in the horizontal direction further improves the stability of the siding.

In order to remove the panel 12, the bottom lip 48 is unsnapped from the top margin 50 of the panel below, or from the bottom J-channel 16. The bottom lip of a panel 12 above, or any soffit piece covering the top margin 50, is unsnapped from the top margin. If there is a nail in the top margin 50 of the panel 12, the nail is removed. Each connector 42 is snapped out of its clip 22. The connectors 42 can be removed one at a time, in any convenient order. Alternatively, if one end of the panel 12 can be exposed, the panel may be slid out sideways after partial unfastening.

Figure 4:
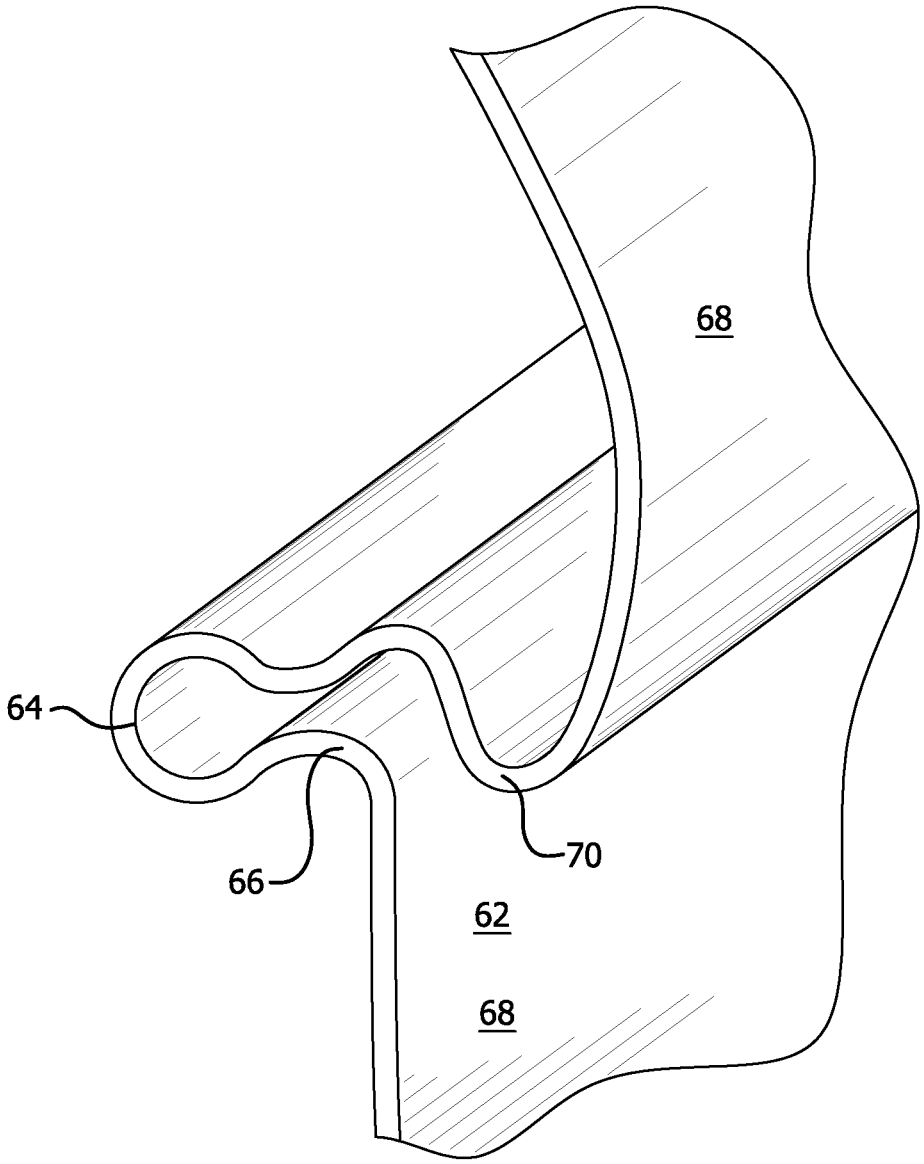
FIG. 4 is a view, similar to FIG. 3, of part of an alternative panel.

The bead 44 of the connector 42 is shown as a solid structure. That may be appropriate if the panel 12 is extruded horizontally, which limits the height of the panel to the width of the extrusion machine, but allows panels 12 of indefinite width. Referring now also to FIG. 4, an alternative form of panel 62 is made of a material that can be shaped by bending. The bead 64 and its supporting rib 66 are formed by a loop of material at the step between planks 68. The inside of the bead 64 and rib 66 then form a groove open to the exterior of the panel 62. To reduce the risk of this filling with rainwater or debris, the panel 68 above the bead is brought down in a loop forming a drip lip 70 that both hides and protects the groove. The panel 62 can then be formed vertically, and can be of indefinite height, but its length would then be limited by the width of the forming machine. The panel 62 shown in FIG. 4 may be used with the clip 22 shown in FIG. 2. Alternatively, because the bead 64 is compressible, it may be used with a more rigid clip 22 in which the block parts 36 are directly attached to the strip 20, omitting the gaps 37.

Although specific embodiments have been described, those skilled in the art will see that various modifications may be made without departing from the spirit or scope of the invention as defined by the appended claims.

The panel 12 shown in FIG. 2 is stepped to imitate traditional wood plank siding. As noted above, that has the advantage that any distortion of the front face opposite the connectors 42 can be camouflaged or hidden at the steps between planks 54. The joint 48, 50 between upper and lower panels 12 can be similarly camouflaged. However, planking is not necessary. Smooth panels 12, or panels formed into other patterns and textures are equally possible.

As noted above, the length of the stringers 10 and the height of the panels 12, 62 are not restricted. A commercial stock may contain stringers 10 of various lengths and panels 12, 62 of various heights. Provided that the configuration and spacing of the clips 22 and the connectors 42 are consistent, the various sizes of component can be made interchangeable. It is then possible to mix panels of different sizes on one wall, which can lead to less custom cutting and more efficient use of the material.

Various dimensions and numerical values have been given for various components of the siding system shown in the drawings. Unless specifically indicated as essential, these dimensions and numbers are only exemplary. It will be seen that most of them have been chosen to give round numbers, or to conform to standard sizes, in the systems of building commonly used in the United States of America. The skilled reader will readily understand how they may be varied for specific implementations, and how they should be varied for conformity with the systems of measurement and standard building systems of other countries.

Where the description uses terms of orientation, such as "vertical," "horizontal," and "upright," those terms should be interpreted purposively, and not too literally. In particular, the walls, structural members and visible edges of an old building are very commonly not exactly vertical and horizontal, and not exactly parallel or perpendicular. The orientation of the stringers 10 and panels 12 when mounted on a specific building is therefore left to the sound judgment of the individual installer. In addition, the stringers 10 and panels 12, in an unassembled state, may be stored and shipped in any orientation.

The invention claimed is:

1. A stringer for a siding system, the stringer comprising:

a base member elongate in a length direction and having a width direction and a depth direction perpendicular to each other and to the length direction; and clips regularly spaced along the length of the elongate member, each clip projecting from the elongate member in the depth direction and defining a channel extending in the width direction, the channel open away from the elongate member in the depth direction through a neck narrower than the channel and extending in the width direction;

wherein each clip is so constructed as to permit an elongated connector extending in the width direction to snap into the channel through the neck, and to support the connector against forces in the length direction while the connector is received in the channel; and wherein each clip comprises a body, within which the channel is formed, mounted on the stringer base member by a stalk narrower than the body in a length direction of the stringer, forming spaces between the clip body and the stringer base member on either side of the clip stalk, and wherein the block is formed of resiliently flexible material, whereby parts of the body separated in the length direction by the channel can flex relative to the stalk of the clip into said spaces to permit the neck of the clip to open to permit the head of a correspondingly dimensioned connector to snap into and out of the channel.

2. The stringer of claim 1, wherein each clip has chamfered surfaces on either side of the channel facing in the length direction of the stringer base member away from the channel and in the depth direction away from the stringer base member, whereby a connector being displaced along the stringer base member towards the clip tends to be deflected by the chamfered surfaces away from the stringer base member and towards the channel of the clip.

3. The stringer of claim 1, further comprising at least three said regularly spaced clips.

4. The stringer of claim 3, further comprising at least six said regularly spaced clips.

5. An upright wall, comprising a plurality of stringers according to claim 1, the stringers being mounted upright in spaced, parallel relation on the wall and aligned so that their respective clips are in horizontal rows.

6. A siding system comprising:

a plurality of elongated stringers according to claim 1; and a siding panel having on a rear face regularly spaced, parallel, elongated connectors, wherein the spacing of the connectors matches the spacing of the clips, each connector adapted to be engaged in the clips of one of the horizontal rows of clips so that the weight of the panel is supported by the clips through the respectively engaged connectors;

wherein each connector comprises a head on a rib narrower than the head, the connector head dimensioned to fit within the clip channel and to snap in and out of the channel through the neck, and the connector rib dimensioned to fit within the clip neck.

7. A stringer for a siding system, the stringer comprising:

a base member elongate in a length direction and having a width direction and a depth direction perpendicular to each other and to the length direction; and clips regularly spaced along the length of the elongate member, each clip projecting from the elongate member in the depth direction and defining a channel extending in the width direction, the channel open away from the elongate member in the depth direction through a neck narrower than the channel extending in the width direction and narrower than the channel in the length direction;

wherein each clip is so constructed as to permit an elongated connector extending in the width direction to snap into the channel through the neck, and to support the connector against forces in the length direction while the connector is received in the channel;

wherein each clip has chamfered surfaces on either side of the channel facing in the length direction of the stringer base member away from the channel and in the depth direction away from the stringer base member, whereby a connector being displaced along the stringer base member towards the clip tends to be deflected by the chamfered surfaces away from the stringer base member and towards the channel of the clip.

8. The stringer of claim 7, wherein the clip neck is bounded on a side away from the stringer base member by beveled surfaces on either side of the neck between the neck and the chamfered surfaces, facing in the length direction towards the neck and in the depth direction away from the stringer base member, whereby a connector being inserted into the clip tends to be guided by the chamfered surfaces into the neck of the clip.

9. The stringer of claim 7, further comprising at least three said regularly spaced clips.

10. The stringer of claim 9, further comprising at least six said regularly spaced clips.

11. An upright wall, comprising a plurality of stringers according to claim 7, the stringers being mounted upright in spaced, parallel relation on the wall and aligned so that their respective clips are in horizontal rows.

12. A siding system comprising:

a plurality of elongated stringers according to claim 7; and a siding panel having on a rear face regularly spaced, parallel, elongated connectors, wherein the spacing of the connectors matches the spacing of the clips, each connector adapted to be engaged in the clips of one of the horizontal rows of clips so that the weight of the panel is supported by the clips through the respectively engaged connectors;

wherein each connector comprises a head on a rib narrower than the head, the connector head dimensioned to fit within the clip channel and to snap in and out of the channel through the neck, and the connector rib dimensioned to fit within the clip neck.

* * * * *